US005788737A

United States Patent [19]

Wakiyama et al.

[11] Patent Number: 5,788,737

[45] Date of Patent: Aug. 4, 1998

[54] ALUMINUM BASE SINTERED MATERIAL

[75] Inventors: Hiroo Wakiyama; Hiroyoshi Kikuchi; Takeshi Sakai, all of Chiba-ken, Japan

[73] Assignee: N.D.C. Co., Ltd., Chiba-ken, Japan

[21] Appl. No.: 762,817

[22] Filed: Dec. 9, 1996

[51] Int. Cl.[6] ..... C22C 21/00

[52] U.S. Cl. ..... 75/249

[58] Field of Search ..... 75/249

[56] References Cited

U.S. PATENT DOCUMENTS

| | | | |
|---|---|---|---|
| 3,232,754 | 2/1966 | Storchheim | 75/214 |
| 3,754,905 | 8/1973 | Knopp | 75/227 |
| 4,715,893 | 12/1987 | Skinner et al. | 75/249 |
| 4,737,339 | 4/1988 | Couper | 419/23 |
| 5,000,781 | 3/1991 | Skinner et al. | 75/249 |
| 5,104,444 | 4/1992 | Shioda et al. | 75/249 |
| 5,292,358 | 3/1994 | Miura et al. | 75/249 |

*Primary Examiner*—Daniel J. Jenkins

*Attorney, Agent, or Firm*—Sughrue, Mion, Zinn, Macpeak & Seas, PLLC

[57] ABSTRACT

Disclosed is an aluminum base sintered material, in which said material comprises base powders 2 of an aluminum or an alloy thereof and numerous endless passages being formed by pores connected to each other, said pores intervening between said base powders 2 adjacent to each other, and in which said material is provided with bridging portions 3 for interconnecting said base powders 2 adjacent to each other, said bridging portions 3 having therein an eutectic structure with a hyper-eutectic compounds and with a containment of the eutectic element and the balance of aluminum.

3 Claims, 4 Drawing Sheets

ALUMINUM BASE SINTERED MATERIAL

BACKGROUND OF THE INVENTION

1. Field Invention

The invention is related to an aluminum base sintered material with numerous endless pores, which is produced by sintering step using a liquid phase of mixtures consisting mainly of an aluminum and it's alloy powders, and more particularly to the aluminum base material with numerous pores, each of which is formed between the aluminum and it's alloy powders, and then are interconnected to each other, resulted in forming a passage permissible for a penetration of air, gas, liquid or the like.

The aluminum base sintered material is superior in mechanical property thereof and admits an effective absorption of noise, disagreeable sound or the like from the rapid train with high speed running, the automoble, the industrial equipment or the like. Additionally, the aluminum base sintered material can be utilized as the filter medium enabling an effective filtration of the liquid.

2. Descriptions of the Prior Art

Hither-to, there are presented various kind of porous metal materials, which are common in a structure with numerous pores interstices or the like. The pores or the like penetrate through from the surface to the opposite face of the material.

By utilizing such porous structure, there are presented various kind of industrial materials, such as a sonic absorption material enable to reject the noise, the disagreeable sound or the like, a filter material permitted for rejecting the solvent from the water or liquid and a deodorizing material enabling to eliminate offensive odor by using an adhesion of disagreeable odor on the internal wall of pore or interstice.

As some example among the porous metal materials, there is provided with a punching metal. The punching metal has therein numerous penetrating straight pores made through an aluminum plate by punching it.

The punching metal admits an economical manufacturing thereof, since the way how to make the punching metal is permissible for use of a method enabling to make it easily.

The punching metal has an effect in a certain degree on the sonic absorption of noise, disagreeable sound or the like, since the penetration pores of the punching metal enable to make a reduction of the sonic energy, during the noise, disagreeable sound or the like passes through the penetrating pores.

In addition to this, the punching metal with the raw material of the aluminum plate enhances the mechanical property to so degree as to be desired, and permits with ease a plastic deformation in a style so as to be desired.

However, the sonic frequency range of the noise, disagreeable sound or the like, in which is permissible for sonic absorption by using the punching metal, is within a low frequency range, for example 100 Hz or below. Consequently, the punching metal cannot achieve a sonic absorption of the noise, disagreeable sound or the like with the sonic frequency range of 500 Hz or over.

Recently, there are generated from the recent development of industry various kind of expected noise sources, from which noise, disagreeable noise or offensive sound may be generated.

One of the unexpected noise source is due to the development of industrial equipment, machine or the like, which may cause a generation of various kinds of offensive noises or disagreeable sounds or the like.

In details, the rapid train, for example, Japanese speaking, "SHINKAN SEN", can make a running with high speed, and in consequence causes a generation of the sounds with high sonic frequency, i.e, 500 to 2000 Hz.

The other of the unexpected noise source is due to the recently designed car. When the recently designed car runs with high speed along the high way, it generates the noise with high sonic frequency. The high sonic frequency comes into question. Additionally, there comes from high rise building, public hall or the like at built-up area, various kind of offensive noise, disagreeable sound or the like, which comes into question.

Thus offensive noise, disagreeable sound or the like, which generate from the above unexpected noise sources, is a mixture containing the sound with high sonic frequency. The noise or the like with high sonic frequency cannot be absorbed and rejected by using the prior art technique, such as the punching metal.

As a result, some aluminum base sintered material, which may be selected instead of the punching metal, is presented as a sonic absorbing material. The aluminum base sintered material has the porous construction and the raw material of aluminum or it's alloy powder, which is disclosed in Japanese patent publications Nos. 18646/1981 and 11375/1981.

The sonic absorbing material of aluminum base sintered material is produced by a method, which is subjected to steps of moulding the mixtures of aluminum powder and aluminum alloy powder including copper, without application of any pressure, and then sintering the mould of the mixture in the surrounding of hydrogen, at the temperature lowering by 10° C. or over from the melting temperature of aluminum.

Thus obtained sonic absorption material has 30% or over by volume of pores.

The copper containing aluminum alloy powder, which is added to aluminum powder, is preferable one. The preferable alloy powder has an eutectic composition (Cu 33%), whose melting temperature is lower than that of other copper containing aluminum alloy. The copper containing aluminum alloy powder with eutectic composition melts and disappears during heating of sintering step, so as to form a skelton, texture, structure or the like of aluminum powders, between which are formed pores or interstices connected to each other. The conventional aluminum sintered material has therein pores or voids connected to each other so as to form an endless passage with a folded style. The passage has a length thereof nearly closed to an infinite long length. By comparison of the porous sintered material with the punching metal, the aluminum base sintered material enables to absorb the offensive noise or disagreeable sound with high sonic frequency, i.e 1000 Hz or over. Furthermore, the aluminum base sintered material has various uses, which extend to the wide spread range, since it's raw material is aluminum or it's alloy with light weight.

However, in spite that the aluminum base sintered material has various advantages, the aluminum base sintered material is inferior in the tensile strength thereof, so that it cannot be subjected to bending working with ease.

For an enhancement of mechanical strength of the sonic absorbing material of the aluminum base sintered material, it is necessary to mold the mixture by applying pressure it so as to form a mold of a compact body to be sintering. But, the mold formation of the compact body interferes with making an increase in porosity of the sonic absorbing material to 30% or over, which enables to absorb with effect noise or sound having wide range of sonic frequency.

Accordingly, the process of the conventional sonic absorbing materials of the aluminum base sintered material lacks the compact body forming step. This lack makes it impossible to increase mechanical strength of the conventional sonic absorbing material. Consequently, the conventional sonic absorbing material is lower in mechanical strength thereof. The mechanical strength is dependent upon the direct contact between aluminum powders of the skelton, texture or the like formed by sintering process. If the direct contact of aluminum powders during the sintering process is undesirable, mechanical strength of aluminum base sintered material is diminished to be lower.

Additionally, instead of the punching metal and the aluminum base sintered material, there are provided with some sonic absorbing materials, which has raw materials, such as glass fiber, slag wool, aluminum fiber or the like. The sonic absorbing materials have therein a large number of internal spaces occupied with air, and hence enable to absorb the offensive noise, the disagreeable sound or the like effectively.

But, the style of the sonic absorbing materials is liable to be varied with ease. With a practical execution of some works by using the sonic absorbing materials, the fibrous pieces and fragment or the like is laid to separate from the sonic absorbing materials and scatter in several directions, and hence injure man's health.

SUMMARY OF THE INVENTION

This invention has for it's object to dissolve the above defects of the prior art aluminum base sintered material, especially to provide an aluminum base sintered material with the endless passage being formed by pores which intervene between adjacent aluminum base powders, in which the adjacent aluminum base powders have therebetween a bridging portion with high mechanical strength and good bending workability, the bridging portion enabling to connect the adjacent aluminum base powders.

Namely, the invention is related to an aluminum base sintered material, which said material comprises base powders of an aluminum or an alloy thereof and numerous endless passages being formed by pores connected to each other, said pores intervening between said base powders adjacent to each other, characterized in that said material is provided with bridging portions for interconnecting said base powders adjacent to each other, said bridging portions having therein an eutectic structure with a hyper-eutectic compounds and with a containment of the eutectic element and the balance of aluminum, said eutectic element being contained in such quantities that it has a content being beyond the eutectic composition enabling a precipitation of the eutectic compound of said eutectic element-aluminum.

BRIEF DESCRIPTION OF THE ATTACHED DRAWINGS

DESCRIPTION OF THE PREFERRED EMBODIMENTS

Figure 1:
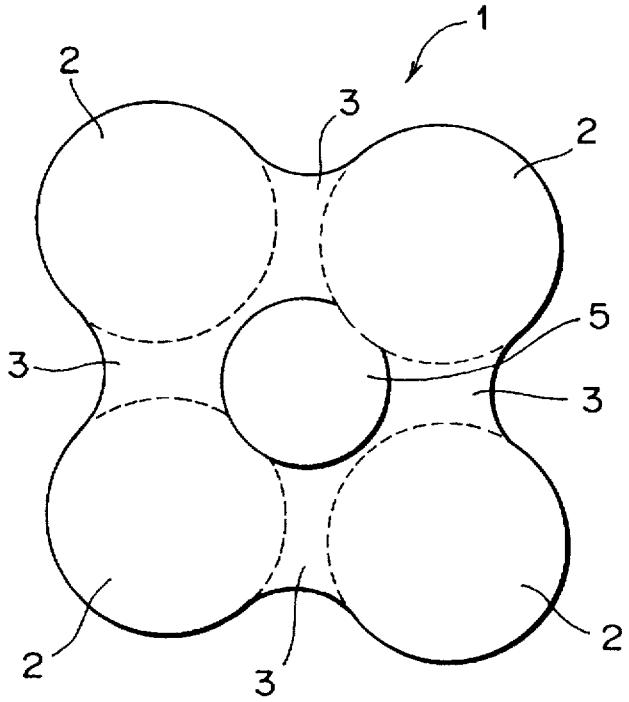
FIG. 1 is an explanatory view showing an enlarged one part of the inventive aluminum base sintered material.

As shown in FIG. 1, numeral reference 1 shows one part of the inventive aluminum base sintered material related to the invention. The aluminum base sintered material 1 has therein base powders 2 of aluminum or it's alloy. Between the base powders 2, 2 adjacent to each other, there are pores 5 connected to each other to form an endless passage. The passage has a length thereof nearly closed to an infinite long length, and extends in several directions as that it is with folded style. The base powders 2, 2 are interconnected by bridging portions 3, which intervenes therebetween. The bridging portion 3 interconnecting the base powders 2, 2 enables to make an enhancement of mechanical strength and toughness of the aluminum base material 1.

Namely, the bridging portion 3 is formed by using a liquid phase sintering step, which causes a partial liquid phase sintering of the raw material powder consisting mainly of the base powder 2 and the eutectic element containing aluminum powder.

On the contrary, unlike the bridging portion 3 shown in FIGS. 1, the conventional aluminum base sintered material has a connecting portion produced by using the face to face contact of the raw material powder consisting mainly of aluminum powder or aluminum alloy powder.

Accordingly, the connecting portion is smaller in diameter thereof, and has lower mechanical strength thereof than that of the raw material powders. The connecting portion is apt to be subjected to the stress concentration, which causes a break-down of the connecting portion. Consequently, the low mechanical strength of the connecting portion causes a reduction of mechanical property of the conventional aluminum base sintered material.

Furthermore, even if the base powder with excellent mechanical property is used, a reduction in the mechanical strength and the toughness of the connecting portion causes to diminish the mechanical strength or property of the conventional aluminum base sintered material.

According to this invention, without forming the connecting portion due to face to face contact of the base powders 2, 2 among the raw material powders the base powders 2, 2 are connected by the intervention of the bridging portion 3, which is formed by participation of the eutectic element containing alloy. The mechanical property of the bridging portion 3 is enhanced, for an improvement of the mechanical property of the aluminum base sintered material 1.

In other words, the eutectic element enabling to participate in a reaction with aluminum, or the aluminum alloy with containment of the eutectic element is added to the base powder 2, and thereby the bridging portion 3 is formed. Accordingly, the mechanical property of the bridging portion 3 is dependent upon the solidified structure formed by a reaction between aluminum powder and the eutectic element containing aluminum alloy.

Namely, even if the eutectic element containing aluminum alloy is same element, the style in combination of the primary crystal and the eutectic crystal to be precipitated is dependent upon a proportion in quantity of the aluminum content and the eutectic element content. In detail, the proportion between the primary crystal and the eutectic crystal to be precipitated in the hypo-eutectic range is unlike that between primary crystal and eutectic crystal in the hyper-eutectic range.

Figure 7:
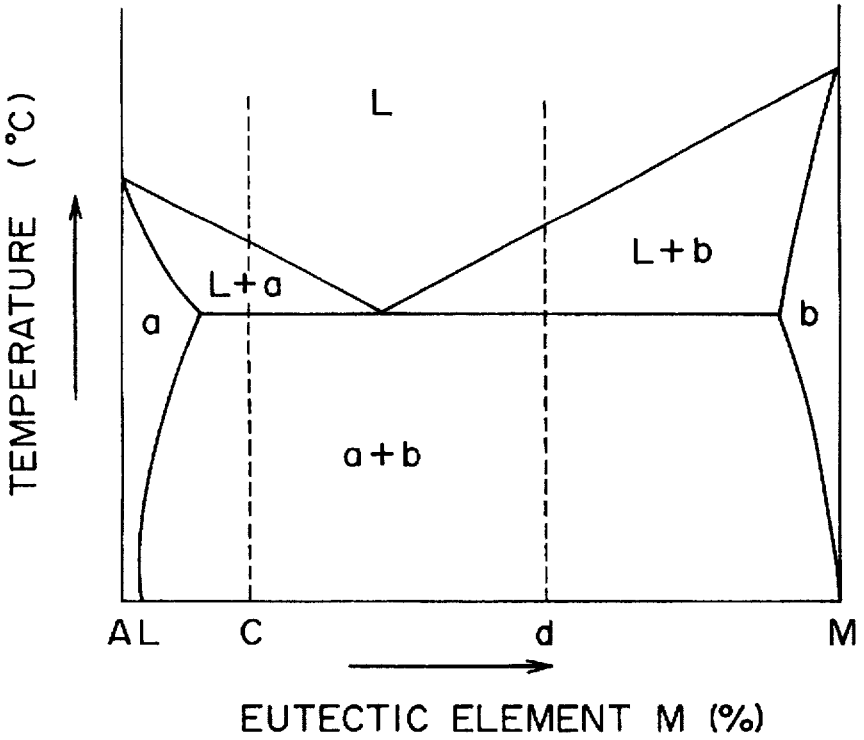
FIG. 7 is an equilibrium diagram of aluminum and eutectic element.

FIG. 7 shows an equilibrium diagram of aluminum and eutectic element (herein-after shown as M). The eutectic element M is assumed to be Copper Cu.

Figure 3:
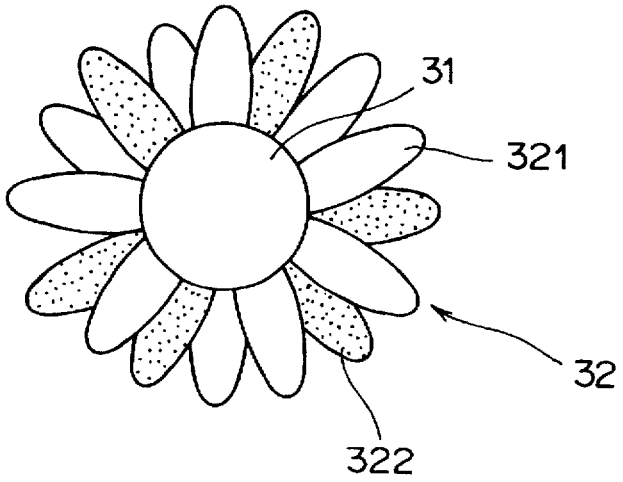
FIG. 3 is an explanatory view showing a style to precipitate a primary crystal and an eutectic composition of the bridging portion of the comparative aluminum base sintered material.

Hypo-eutectic composition (shown as the composition C in FIG. 7) of Al—Cu alloy means one comparative example. The comparative example enables to make a solidification and simultaneous precipitation of some primary crystal 31 at primary stage, in which primary crystal 31 is shown in FIG. 3. The primary crystal 31 is with containment of a large amount of aluminum and has good toughness and softness.

At the secondary stage after solidification and precipitation of the primary crystal 31, the solidification and simultaneous precipitation of the eutectic mixture 32 of the hypo-eutectic composition rise on the peripheral surface of the primary crystal 31. The eutectic mixture 32 has therein the solid solution 321 with a containment of a large amount of aluminum and the intermetallic compound 322 i.e. $CuAl_2$ and the eutectic mixture 32 also surrounds the peripheral surface of the primary crystal 31.

Figure 4:
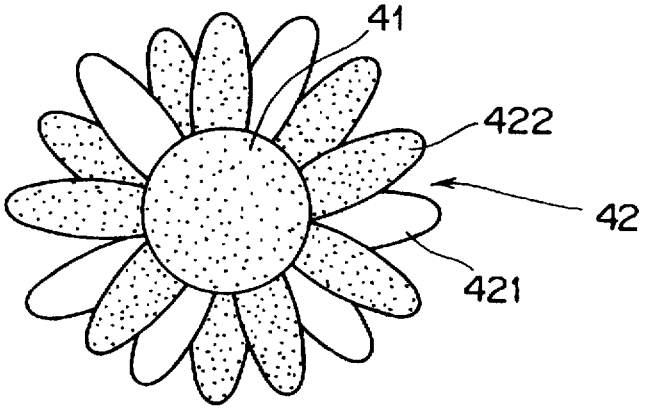
FIG. 4 is an explanatory view showing a style to precipitate a primary crystal and an eutectic composition of the bridging portion of the inventive aluminum base sintered material.

Hyper-eutectic composition (shown as the composition d in FIG. 7), by which the bridging portion 3 according to the invention is constructed enables to make the solidification and simultaneous precipitation of intermetallic compound, which constitutes a primary crystal 41, as shown in FIG. 4. At the secondary stage after solidification and simultaneous precipitation a primary crystal 41 of intermetallic compound, the solidification and simultaneous precipitation of the eutectic mixture 42 of the hyper-eutectic composition rise on the peripheral surface of the primary crystal 41 consisting mainly of intermetallic compound. The eutectic mixture 42 contains a large amount of the intermetallic compound 422 and a small amount of the solid solution 421 with containment of a large amount of aluminum, as shown in FIG. 4.

As shown above, the eutectic element M has therein a melting point higher than that of aluminum.

Furthermore, the intermetallic compound 422 included in the eutectic mixture 42 of hyper-eutectic composition has therein higher melting point and hardness than aluminum. Accordingly, during the sintering step at high temperature permitted for melting aluminum, any softening does not rise to the intermetallic compound 422.

As shown above, the hardness of the comparative bridging portion with the hypo-eutectic composition of the comparative example (shown in FIG. 3) increases from the center to the peripheral surface thereof, while the hardness of the bridging portion 42 with hyper-eutectic composition of the invention (shown in FIG. 4) diminishes from the center to the peripheral surface thereof.

By comparison between two types of eutectic mixtures 32 and 42, the eutectic mixture 42 precipitated in a range of the hyper-eutectic composition has therein a containment of intermetallic compound 422 more than that of solid solution 421, and hence enhances the mechanical strength of the bridging portion 3.

According to this invention, the bridging portion 3 is constructed in a style so that it has the hyper-eutectic composition. This construction of the bridging portion 3 enables to improve at great degree mechanical property and bending workability thereof, because the eutectic mixture 42 of the hyper-eutectic composition includes solid solution with a good toughness.

Figure 5:
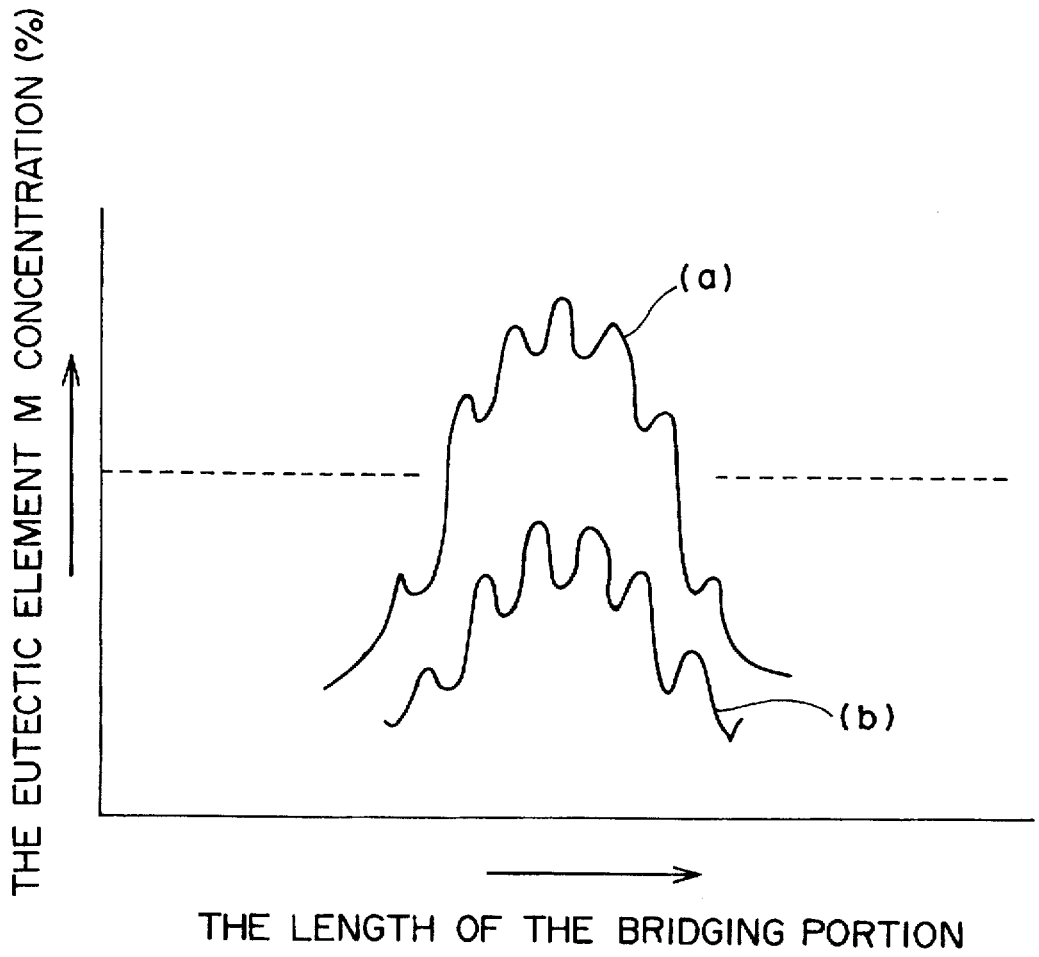
FIG. 5 is a graph showing the length of the bridging portion and the concentration of the eutectic element.
Figure 6:
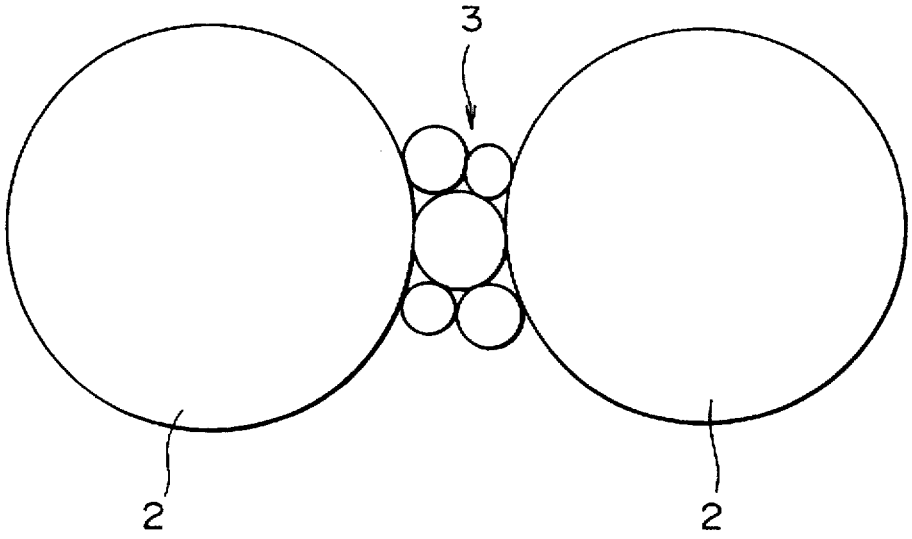
FIG. 6 is an explanatory view showing the bridging portion with the state before sintering step.

FIG. 5 shows a relation between the eutectic element concentration and the length of the bridging portion. In FIG. 5, reference numeral (a) shows the inventive bridging portion with the hyper-eutectic composition and reference numeral (b) shows the comparative bridging portion with the hypro-eutectic composition. Furthermore, FIG. 5 has a vertical axis of the concentration of eutectic element and a horizontal axis of the length bridging portion. FIG. 5 shows that the concentration of the eutectic element M in a range of the hyper-eutectic composition is higher than that of the eutectic element M in a range of the hypro-eutectic composition. Consequently, the bridging portion with hyper-eutectic composition has high yield strength and also exhibits a style, in which ratio between the eutectic element concentration and the length of the bridging portion becomes bigger, as shown in FIG. 5.

Consequently, it is clear that the eutectic reaction of the eutectic element M with the base alloy of aluminum proceeds in great degrees and the resultant bridging portion increases in the mechanical strength thereof. According to the invention, the bridging portion intervening adjacent base powders of aluminum or it's alloy is constructed so that it has therein the hyper-eutectic structure formed by using the addition of the eutectic element M, which has higher a melting point than that of aluminum and enables to make an eutectic reaction with aluminum.

In detail, the primary stage of the sintering step at the temperature over the eutectic temperature enables to make a precipitation of primary crystal 41 constituting a core of intermetallic compound formed by participation and reaction of the eutectic element M and aluminum.

The secondary stage enables to make a precipitation of the eutectic mixture 42 at a position surrounding the primary crystal 41 constituting the core of the bridging portion 3. The eutectic mixture 42 is formed by the solid solution 422 and has better toughness than the core of the primary crystal 41.

Figure 2:
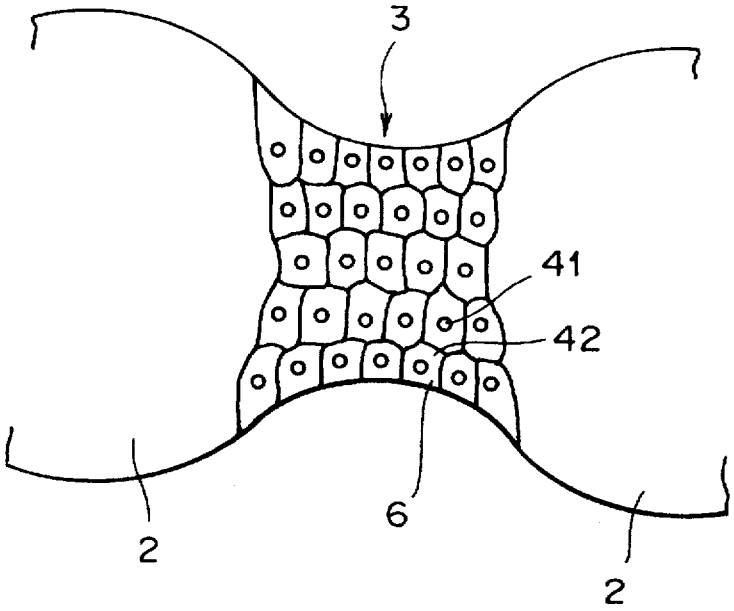
FIG. 2 is an explanatory view showing an eutectic structure of a bridging portion of the inventive aluminum base sintered material.

Namely, as shown in FIG. 2, the bridging portion 3 is divided into sections 6, each of which are connected in a sequence. Each of sections 6 is provided at the center thereof with the core of the primary crystal 41 with a good mechanical property.

There is provided at a position surrounding the core of the primary crystal 41 with the eutectic mixture 42, which has therein the solid solution 422 (shown in FIG. 3).

Adjacent sections 6, 6 are connected to each other, by the eutectic mixtures 42, 42 thereof, which are connected in a style of continuous form.

In consequence, the bridging portion 3 has a good structure or texture, which comprises continuous eutectic mixture 42 with a high toughness. The continuous eutectic mixture 42 is provided at the center thereof with the cores of primary crystal 42 with a form of fine particles, which is arranged in the state of being dispersed. As described above, the bridging portion 3 has thus-constructed texture, structure or the like, and hence has thereon high strength and hardness.

The inventive aluminum base sintered material has such texture, structure or the like, and hence has a good toughness, higher mechanical strength and a good bending workability, which implys to be able to be bent with ease.

The eutectic element M, which takes part in a formation of the bridging portion may be selected in consideration of the melting point thereof and the reactivity with aluminum base powder. The preferable examples of the eutectic element M are such as, silicon, nickel, manganese or copper, as shown in Table 1.

TABLE 1

| eutectic element M | melting point (°C.) | eutectic temperature (°C.) | eutectic compound (wt %) | content of the hyper-eutectic composition (wt %) |
|---|---|---|---|---|
| Si | 1430 | 577 | 11.7 | 100 |
| Ni | 1455 | 640 | 5.7 | 42.0 |
| Mn | 1245 | 658.5 | 2.0 | 25.3 |
| Cu | 1083 | 548 | 33.0 | 52.5 |

As to the addition of the eutectic element M, it is preferable that the eutectic element M is alloyed with aluminum so as to form an aluminum-eutectic element alloy to be added.

The addition of the aluminum-eutectic element alloy can utilize the liquid phase sintering step, by which the bridging portion is easily provided with the above-said construction, such as a construct with the hyper-eutectic composition.

In the case when the bridging portion is formed by addition of aluminum-eutectic element alloy and by utilization of the liquid phase sintering step, preferable examples of aluminum-eutectic element alloy to be added is following.

The amount of eutectic element M to be added should be within the lower and upper limits.

Namely, the lower limit of the eutectic element corresponds to a composition, in which the eutectic compound is precipitated according to the equilibrium diagram between aluminum and eutectic element alloy.

On the contrary, the upper limit of the eutectic element is selected in accordance with a range, in which some solid solution can be formed by the participation of the eutectic element and the aluminum.

For example, when the eutectic element M is silicon, silicon has a melting point of 1430° C., while aluminum has a melting point of 660° C.

Accordingly, the melting point of silicon is at a great extent higher, compared with the melting point of aluminum.

Furthermore, according to the equilibrium diagram between silicon and aluminum, the eutectic composition of silicon is 11.7% Si and an eutectic reaction temperature is 577° C. Accordingly, for precipitation of the eutectic mixture with hyper-eutectic structure, silicon content is necessitated beyond the eutectic composition of 11.7% Si, and hence a preferable silicon content is 15.0% or over.

Additionally, since silicon is a metal with high melting temperature, silicon powder only cannot be sintered. Therefore, silicon content has a upper limit thereof below 100% Si.

In the case when copper is used as an eutectic element M, the copper content inevitable for precipitating the eutectic composition of aluminum and copper is 33% Cu. For precipitating the eutectic mixture with the hyper-eutectic composition, copper content is necessitated for the addition of beyond 33% Cu.

But, copper content beyond 52.5% Cu causes a formation of Al—Cu intermetallic compound with high hardness, without a formation of solid solution by participation of aluminum. In other words, copper content of 52.5% Cu or over precipitates eutectic mixtures comprising mainly of intermetallic compound, which lacks in great degrees toughness and workability.

Namely, the eutectic mixtures comprising mainly of intermetallic compound connected to each other has high hardness, but lacks toughness.

Therefore, it has poor resistance against breakage of the inventive bridging portion.

On the other hand, the eutectic mixtures of the inventive bridging portion have therein the hyper-eutectic composition. The hyper-eutectic composition comprises the solid solution together with the intermetallic compound, as shown in FIG. 4. The solid solution contains a lot of aluminum and hence is superior in toughness thereof.

Accordingly, one of the inventive feature exists in the provision with the hyper-eutectic mixtures containing the solid solution formed by participation of aluminum and the eutectic element M.

In the eutectic mixtures with the hyper-eutectic composition, the content of the eutectic element may be selected in accordance with mechanical property inevitable for the use of the sintered materials. For example, in the case of obtaining the sintered material with a high mechanical strength, the eutectic composition with containment of a lot of the eutectic element M is suitable.

On the contrary, in the case of obtaining the sintered material with a good workability, the eutectic composition, which contains the eutectic element M in a proportion closed to the content inevitable for precipitating the eutectic compound, is suitable.

To this end, preferable ranges of silicon, nickel, manganese and copper contents are 15 to 80%, 6 to 42%, 3 to 20% and 35 to 52%, respectively.

Additionally, in the case of addition of the eutectic element M in a form of an alloy powder formed by participation of aluminum, the alloy powder has a content of the eutectic element M, which is dependent upon the porosity obtained after sintering step. The increase in quantities of the eutectic element M to be added makes amounts of the liquid phase to be produced greater, so as to produce a desired effect in sintering step, so that the porosity obtained after sintering step has a tendency of becoming lower.

By assumption that the bridging portion is constructed with the eutectic mixtures with hypo-eutectic composition, it is necessary to make the diameter of the bridging portion greater, for producing a desired mechanical strength. This is because the hypo-eutectic composition is poor in mechanical strength thereof. For making the diameter of the bridging portion, greater, a great amount of the eutectic element M to be added is required. The larger addition of the eutectic element M is resulted in too much production of the liquid phase, which makes the porosity lower. Consequently the desired degree of the porosity inevitable for the sonic absorption material and the filtering material cannot be obtained.

The Example of the Invention is Below

Example

The mixtures consisting of the aluminum base powder and the eutectic element M was prepared in accordance with particulars shown in Table 2, for the purpose of forming the bridging portion of the inventive aluminum base sintered material.

TABLE 2

| | | A | | | E | | |
|---|---|---|---|---|---|---|---|
| | Z | B | C | D | F | G | H |
| X | 1 | 99.8% Al | 80 | 94 | Al-25% Si | 150 | 6 |
| | 2 | Al-0.45% Cu | 80 | 90 | Al-10% Ni | 150 | 10 |
| | 3 | 99.8% Al | 80 | 93 | Al-20% Mn-15% Si | 150 | 7 |
| | 4 | 99.8% Al | 80 | 94 | Al-50% Cu | 150 | 6 |
| Y | 21 | 99.8% Al | 80 | 91 | Al-33% Cu | 150 | 9 |
| | 22 | 99.8% Al | 80 | 80 | Al-15% Cu | 150 | 20 |
| | 23 | 99.8% Al | 80 | 95 | Al-60% Cu | 150 | 5 |

X: inventive examples
Y: comparative examples
Z: sample Nos.
A: aluminum base powder
B: composition of the aluminum base powder
C: average size of the aluminum base powder (mesh)
D: percentage of the aluminum base powder (wt %)
E: eutectic element containing Al alloy powder for forming the bridging portion
F: composition of the eutectic element containing Al alloy powder
G: average size of the eutectic element containing Al alloy powder (mesh)
H: percentage of the eutectic element containing Al alloy powder (wt %)

And then the mixtures was subjected to the sintering step, which was conducted in accordance with particulars shown in Table 3.

Bending workability implys minimum diameter without any breakage obtained at the time of winding samples with thickness of 2.5 mm around the bar-like body with a certain diameter. Therefore, the reduction of minimum diameter makes an increase in the bending workability of the bridging portion.

Sonic absorption ratio implys a ratio obtained by using sonic wave with frequency ranging between 1000 and 1600 Hz.

Sample 4 is superior in mechanical tensile strength thereof, compared with the mechanical tensile strength of comparative samples 21, 22 and 23.

Sample 4 has bending workability and sonic absorption ratio, which are equal or over those of comparative samples 21, 22 and 23.

As shown above, the inventive aluminum base sintered material is provided between the base powder of aluminum or it's alloy with the bridging portion having therein the hyper-eutectic composition.

Consequently, the inventive sintered material has high mechanical strength and superior bending workability. Furthermore, it is possible to make diameter of the bridging portion smaller, and hence to make porosity of the sintered material greater. The inventive sintered material is suitable for the sonic absorption material used for rapid train, such as Japanese speaking "SHINKAN SEN", can and industrial equipment.

TABLE 3

| | | I | | | | | | | | |
|---|---|---|---|---|---|---|---|---|---|---|
| | Z | J | K | L | M | N | O | P | Q | R |
| X | 1 | 645 | 20 | $H_2$ | Al-1.5% Si | 43 | 2.9 | ϕ27 | 0.90 | Si 18 |
| | 2 | 655 | 10 | ↑ | Al-0.4% Cu-1% Ni | 42 | 3.1 | ϕ34 | 0.95 | Ni 7 |
| | 3 | ↑ | 20 | $H_2 + N_2$ | Al-1.4% Mn-1% Si | 45 | 2.4 | ϕ22 | 0.90 | Mn 5 |
| | 4 | 620 | 30 | $H_2$ | Al-3% Cu | 46 | 3.5 | ϕ43 | 0.87 | Cu 37 |
| Y | 21 | 620 | 30 | $H_2$ | Al-3% Cu | 47 | 2.2 | ϕ61 | 0.85 | Cu 32 |
| | 22 | ↑ | ↑ | ↑ | Al-3% Cu | 32 | 2.0 | ϕ43 | 0.65 | Cu 14 |
| | 23 | ↑ | ↑ | ↑ | Al-3% Cu | 52 | 1.7 | ϕ89 | 0.80 | Cu 53 |

X: inventive examples
Y: comparative examples
Z: sample Nos.
I: sintering condition
J: sintering temperature (°C.)
K: sintering period (minute)
L: sintering surroundings
M: chemical composition of the aluminum base sintered material
N: porosity of the aluminum base sintered material (%)
O: tensile strength of the aluminum base sintered material (kgf/mm$^2$)
P: bending workability obtained by the bending test of the aluminum base sintered material (minimum diameter)
Q: sonic absorption ratio of the aluminum base sintered material
R: concentration of eutectic element contained in the bridging portion of the aluminum base sintered material (%)

As a result, the aluminum base sintered materials with numerous pores were produced, which have various properties, such as porosity, tensile strength, bending workability (min. diameter), sonic absorption ratio and concentration of eutectic element of bridging portion, which are shown in Table 3.

Additionally, tables 2 and 3 shows respectively samples 21, 22 and 23, which imply in common the comparative materials, respectively. Especially, sample 21 shows Al—Cu alloy with eutectic composition, sample 22 shows Al—Cu alloy with hypo-eutectic composition, and sample 23 shows Al—Cu alloy with containment of eutectic element beyond the upper limit of eutectic element of hyper-eutectic composition.

What is claimed is:

1. A porous aluminum base sintered material, in which said material is prepared by sintering base powders of aluminum or an alloy thereof to form pores intervening between particles of said base powder adjacent to each other, wherein said base powder particles adjacent to each other are interconnected by bridging portions, each of said bridging portions contains aluminum and an eutectic element enabling formation of an eutectic structure with aluminum with the content of said eutectic element exceeding an eutectic point of the equilibrium diagram of an aluminum-eutectic element system.

2. A porous aluminum base sintered material as claimed according to the claim 1, wherein said eutectic element contains at least one element selected from the group consisting of silicon exceeding 11.7% (not included), manganese ranging from 2.0% (not included) to 25.3%, or copper ranging from 33.0% (not included) to 52.5% of copper.

3. A porous aluminum base sintered material as claimed according to the claim 1, wherein said bridging portion has therein a hyper-eutectic texture, in which said texture is provided at a center area thereof with a core consisting mainly of the intermetallic compound resulted by chemical reaction of said eutectic element with aluminum, and in which said texture is provided at an area thereof surrounding said center area with the eutectic texture consisting mainly of the aluminum crystal and the eutectic element crystal.

* * * * *